US008821698B2

(12) United States Patent
Moghbeli

(10) Patent No.: US 8,821,698 B2
(45) Date of Patent: Sep. 2, 2014

(54) MULTIPURPOSE SEGMENTED TITANIUM MIXED METAL OXIDE (MMO) COATED ANODE WITH INTEGRATED VENT

(76) Inventor: Omidreza Moghbeli, Rancho Cucamonga, CA (US)

( * ) Notice: Subject to any disclaimer, the term of this patent is extended or adjusted under 35 U.S.C. 154(b) by 567 days.

(21) Appl. No.: 13/191,796

(22) Filed: Jul. 27, 2011

(65) Prior Publication Data

US 2012/0031751 A1 Feb. 9, 2012

Related U.S. Application Data

(60) Provisional application No. 61/370,742, filed on Aug. 4, 2010.

(51) Int. Cl.

| | |
|---|---|
| ***C23F 13/00*** | (2006.01) |
| ***C23F 13/10*** | (2006.01) |
| ***C23F 13/18*** | (2006.01) |
| ***C23F 13/20*** | (2006.01) |

(52) U.S. Cl.

CPC ..... *C23F 13/10* (2013.01); *C23F 2213/32* (2013.01); *C23F 13/18* (2013.01); *C23F 13/20* (2013.01)

USPC ..... 204/196.31; 204/196.01; 204/196.08; 204/196.3; 204/196.36; 205/724; 205/734; 205/735; 205/740

(58) Field of Classification Search

CPC ..... C23F 13/00; C23F 13/02; C23F 13/08; C23F 13/20; C23F 13/14; C23F 13/16; C44B 2111/265; C04B 2111/265

USPC ..... 205/724, 734, 735, 740; 204/196.01, 204/196.36, 196.08, 196.31, 196.18, 284, 204/290.12

See application file for complete search history.

(56) References Cited

U.S. PATENT DOCUMENTS

| | | | | |
|---|---|---|---|---|
| 3,632,498 | A * | 1/1972 | Beer | 204/290.12 |
| 4,170,532 | A * | 10/1979 | Tatum | 204/196.3 |
| 4,604,178 | A * | 8/1986 | Fiegener et al. | 204/288.5 |
| 5,176,807 | A * | 1/1993 | Kumar | 204/196.06 |
| 5,547,232 | A * | 8/1996 | Waterman | 285/236 |
| 5,885,427 | A * | 3/1999 | Pickering et al. | 204/293 |
| 7,635,237 | B2 * | 12/2009 | Spears et al. | 405/211.1 |
| 2012/0064643 | A1 * | 3/2012 | Bawolek et al. | 438/16 |

OTHER PUBLICATIONS

Google Patent translation of CN 2008/20153302.*
Espacenet translation and drawings of CN 2008/20153302.*

* cited by examiner

*Primary Examiner* — Luan Van
*Assistant Examiner* — Alexander W Keeling
(74) *Attorney, Agent, or Firm* — Kenneth L. Green

(57) ABSTRACT

A multi purpose segmented Titanium Mixed Metal Oxide coated impressed current cathodic protection anode assembly (Ti MMO anode assembly). The Ti MMO anode assembly includes combinations selected from four anode components and four connection components. The various components may be assembled for different applications in liquid or soil environments for the prevention or reduction of corrosion and loss of structural integrity. For example, the Ti MMO anode assembly may be applied to protect pipelines, buried structures, piers and internal surface protection of tanks and vessels in different arrangements such as deep wells, shallow ground beds, or distributed individual anodes.

4 Claims, 6 Drawing Sheets

MULTIPURPOSE SEGMENTED TITANIUM MIXED METAL OXIDE (MMO) COATED ANODE WITH INTEGRATED VENT

The present application claims the priority of U.S. Provisional Patent Application Ser. No. 61/370,742 filed Aug. 4, 2010, which application is incorporated in its entirety herein by reference.

BACKGROUND OF THE INVENTION

The present invention relates to an impressed current anode assembly and more particularly to a segmented titanium Mixed Metal Oxide (MMO) coated anode assembly.

Known MMO cathodic protection anodes are selected and shipped as a unit including attached anode wires to a final location for installation. Such known MMO cathodic protection anodes are selected from an inventory which may be either a small inventory requiring compromises in selection, or a large inventory which is very expensive to maintain. Known vertical deep well ground bed installations require parallel PVC vent pipes for venting gasses created by the cathodic protection and further, multiple anodes require wire splices to connect the anode wires together, or require extending each anode wire to ground level to individually connect to a junction box. Using multiple independent anodes compromises ground bed resistance and stability and reduces the effectiveness of anodes because multiple anode lead wires and vent pipes isolate the anodes from the ground bed decreasing the effective surface area of the anodes.

BRIEF SUMMARY OF THE INVENTION

The present invention addresses the above and other needs by providing a multi purpose segmented titanium Mixed Metal Oxide coated impressed current cathodic protection anode assembly (Ti MMO anode assembly). The Ti MMO anode assembly includes combinations selected from four anode components and four connection components. The various components may be assembled for different applications in liquid or soil environments for the prevention or reduction of corrosion and loss of structural integrity. For example, the Ti MMO anode assembly may be applied to protect pipelines, buried structures, piers and internal surface protection of tanks and vessels in different arrangements such as deep wells, shallow ground beds, or distributed individual anodes.

In accordance with one aspect of the invention, there is provided a non-vented titanium MMO anode assembly for use in liquid mediums and a vented titanium MMO anode assembly for use in solid mediums. The vented titanium MMO anode segments includes a hollow pass through, hollow center, and ports through walls of the vented titanium MMO anode segments allowing gases released during operation to enter the vented titanium MMO anode segments and pass through and out of the vented Titanium MMO anode segment assembly.

In accordance with another aspect of the invention, there are provided threaded MMO coated titanium couplers and MMO coated anode segments. Combining the threaded mixed metal oxide coated titanium couplers with the MMO coated anode segments, allows creation of a scalable segmented anode. A power supply to the MMO coated anode segments is then connected to a wire connection anode section which comprises a foot long tube with no perforations and a press fit method of cable connection which is made in a neck portion preferably at the center of the tube.

In accordance with yet another aspect of the invention, there are provided threaded MMO coated titanium couplers and MMO coated anode segments providing an electrical path through the anode segments to the surface. The multiple anode wires of known anode assemblies are eliminated thereby significantly improving the ground bed stability and simplifying installation. The anode segments have a minimum wall thickness of about 0.08 inches to provide necessary electrical conductivity.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
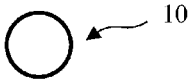
FIG. 1B is a top view of the vented Titanium MMO anode segment according to the present invention.
Figure 1A:
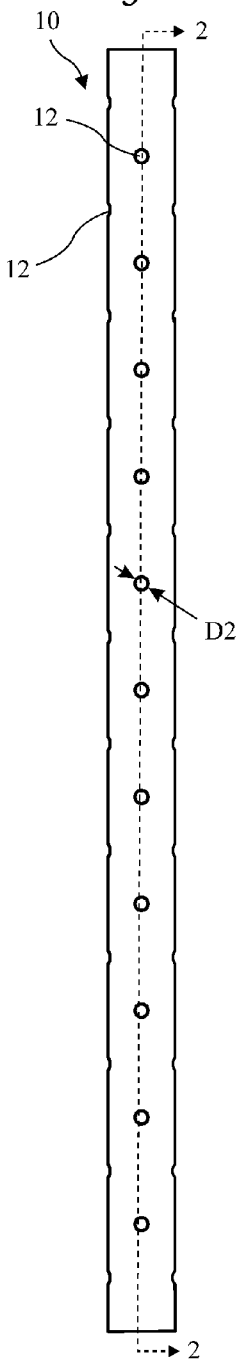
FIG. 1A is a side view of a vented Mixed Metal Oxide (MMO) coated impressed current cathodic protection titanium anode segment (vented MMO anode segment) according to the present invention.
Figure 2:
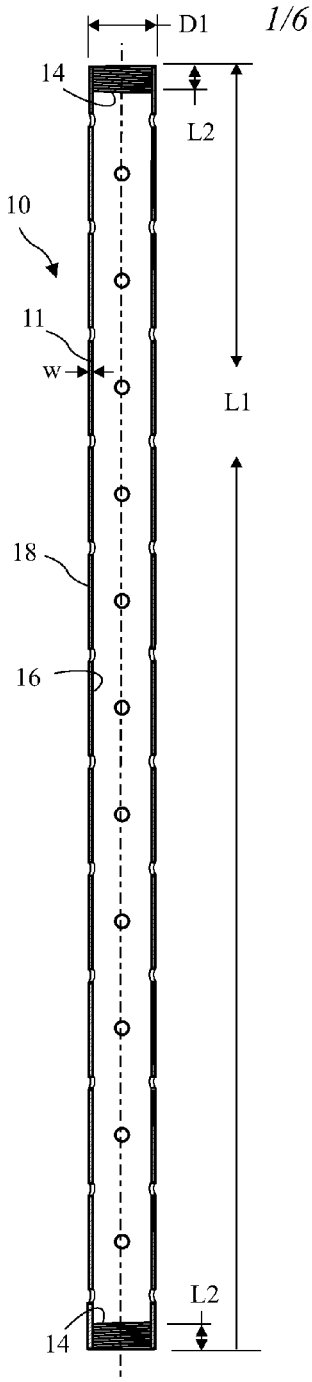
FIG. 2 is a cross-sectional side view of the vented Titanium MMO anode segment according to the present invention taken along line 2-2 of FIG. 1A.

A side view of a vented Titanium Mixed Metal Oxide coated impressed current cathodic protection anode segment (Ti MMO anode segment) 10 according to the present invention is shown in FIG. 1A, a top view of the vented Ti MMO anode segment 10 is shown in FIG. 1B, and a cross-sectional side view of the vented Ti MMO anode segment 10 taken along line 2-2 of FIG. 1A is shown in FIG. 2. The vented Ti MMO anode segment 10 is a primary element of a multi purpose segmented titanium Mixed Metal Oxide coated impressed current cathodic protection anode assembly (Ti MMO anode assembly) 72*a*, 72*b*, 80, and 91 (see FIGS. 14-16) according to the present invention. The vented Ti MMO anode segment 10 is hollow and includes ports 12 allowing gasses generated during operation of the vented MMO anode segment 10 to vent through the vented Ti MMO anode segment 10. The vented Ti MMO anode segment 10 has an external MMO coating 18 and an internal MMO coating 16. The MMO coating is preferably 10 g/m$^2$ of MMO made up of Iridium, tantalum and titanium oxides for soil mediums, and 20 g/m$^2$ for liquid mediums. Preferably, the coating is omitted on female threads 14. The vented Ti MMO anode segment 10 is preferably constructed of titanium having a thickness to provide sufficient electrical conductivity.

The vented Ti MMO anode segment 10 has a length L1, an outside diameter D1, and a wall 11 thickness W. The length L1 is preferably approximately 24 inches, the diameter D1 is preferably approximately 1.25 inches, and the wall 11 thickness W is preferably at least 0.08 inches, and more preferable approximately 0.08 inches. The ports 12 are preferably in opposing pairs with each pair rotated 90 degrees from adjacent pairs. The consecutive pairs of ports are spaced a distance L2 apart and have a diameter D2. The length L2 is preferably approximately one inch and the diameter D2 is preferably approximately 0.25 inches. Each end of the vented Ti MMO anode segment 10 includes internal female threads 14 having a length L2. The length L2 is preferably approximately 0.5 inches. The female threads 14 are preferably 1.25 inches by acme 2G threads, or M29 threads.

Figure 3B:
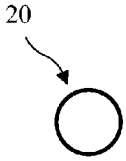
FIG. 3B is a top view of the non-vented Titanium MMO anode segment according to the present invention.
Figure 3A:
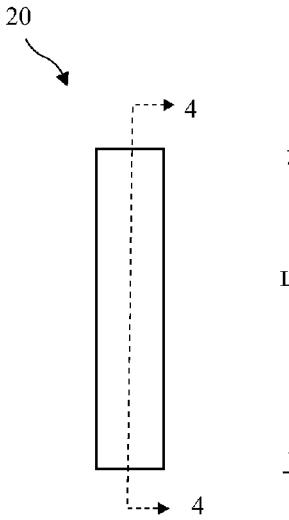
FIG. 3A is a side view of a non-vented MMO coated impressed current cathodic protection titanium anode segment (non-vented MMO anode segment) for use in liquid mediums, according to the present invention.
Figure 4:
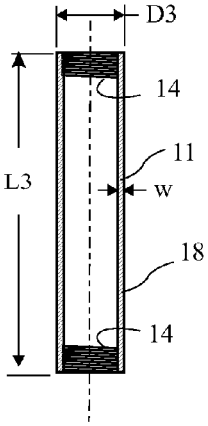
FIG. 4 is a cross-sectional side view of the non-vented Titanium MMO anode segment according to the present invention taken along line 4-4 of FIG. 3A.

A side view of a non-vented MMO coated impressed current cathodic protection titanium anode segment (non-vented MMO anode segment) 20 according to the present invention is shown in FIG. 3A, a top view of the non-vented Titanium MMO anode segment 20 is shown in FIG. 3B, and a cross-sectional side view of the non-vented Titanium MMO anode segment 20 taken along line 4-4 of FIG. 3A is shown in FIG. 4. The non-vented Titanium MMO anode segment 20 includes the external MMO coating 18 and does not include the ports 12.

The non-vented Titanium MMO anode segment 20 has a length L3, an outside diameter D3, and a wall 11 thickness T. The length L3 is preferably approximately six inches, the diameter D3 is preferably approximately 1.25 inches, and a wall 11 thickness W is preferably approximately 0.08 inches. The non-vented Titanium MMO anode segment 20 is otherwise similar to the vented Ti MMO anode segment 10.

Figure 5B:
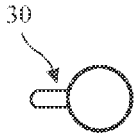
FIG. 5B is a top view of the vented wire connection anode section according to the present invention for connection with the vented MMO coated impressed current cathodic protection titanium anode segment.
Figure 5A:
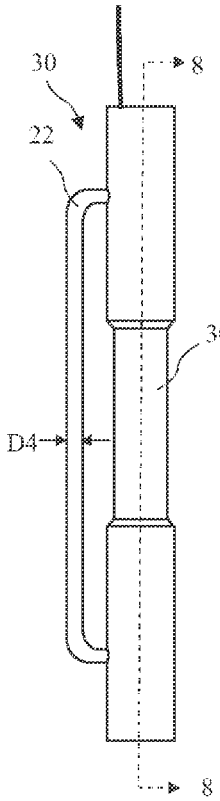
FIG. 5A is a side view of a vented wire connection anode section according to the present invention for connection with the vented MMO coated impressed current cathodic protection titanium anode segment.
Figure 6:
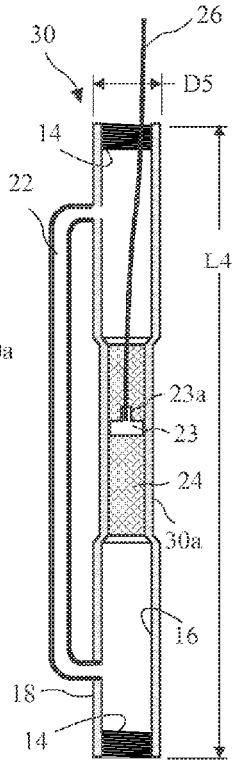
FIG. 6 is a cross-sectional side view of the vented wire connection anode section according to the present invention for connection with the vented MMO coated impressed current cathodic protection titanium anode segment taken along line 6-6 of FIG. 5A.

A side view of a vented wire connection anode section 30 according to the present invention for connection with the vented Ti MMO anode segment 10 is shown in FIG. 5A, a top view of the vented wire connection anode section 30 is shown in FIG. 5B, and a cross-sectional side view of the vented wire connection anode section 30 taken along line 6-6 of FIG. 5A is shown in FIG. 6. The vented wire connection anode section 30 includes a smaller diameter neck 30*a* center portion for connection of an insulated lead 26. The insulation on the lead 26 may be selected to the environment the lead 26 resides in. The neck 30*a* is filled with an isolation material 24 which is preferably a two part epoxy or the similar material. The lead 26 reaches into the neck 30*a* and is electrically connected to the vented wire connection anode section 30 through a press fit wire connector 23 into the neck 30*a* of the wire connection anode section 30.

A major failure mode of known cathodic protection systems is due to the breakdown of the electrical connection between the cable joints and anodes. These failures will take place, when the anodes connections are joined by ring terminals or other methods of connection. To prevent such failures, electrical connections between the lead 26 and wire connector 23 are preferably made using crimping of the wire connector 23 over a stripped end of the lead 26. A crimp 23*a* in the wire connector 23 holds an end portion of the lead 26 with insulation stripped to retain and make electrical contact with the lead 23. The wire connector 23 is preferably copper.

A vent tube 22 connects upper and lower portion of the vented wire connection anode section 30 to allow gasses collected by the vented Ti MMO anode segment 10 to pass through the vented wire connection anode section 30 to be released. The vent tube 22 is preferably approximately 0.5 inches in diameter. The vented wire connection anode section 30 preferably includes the same female threads 14 as the vented Ti MMO anode segment 10. The vented wire connection anode section 30 has an outside diameter D5 and a length L4. The diameter D5 is preferably the same as the diameter D1, and the length L4 is preferably approximately twelve inches.

Figure 7B:
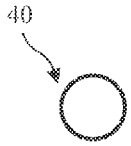
FIG. 7B is a top view of the non-vented wire connection anode section according to the present invention for connection with the non-vented MMO coated impressed current cathodic protection titanium anode segment.
Figure 7A:
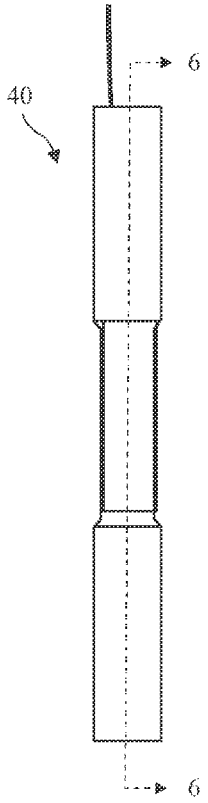
FIG. 7A is a side view of a non-vented wire connection anode section according to the present invention for connection with the non-vented MMO coated impressed current cathodic protection titanium anode segment.
Figure 8:
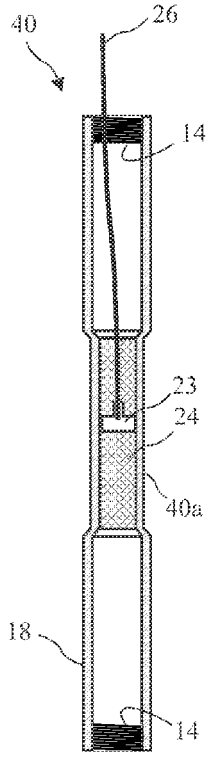
FIG. 8 is a cross-sectional side view of the non-vented wire connection anode section according to the present invention for connection with the non-vented MMO coated impressed current cathodic protection titanium anode segment taken along line 8-8 of FIG. 7A.

A side view of a non-vented wire connection anode section 40 according to the present invention for connection to the non-vented Titanium MMO anode segment 20 is shown in FIG. 7A, a top view of the non-vented wire connection anode section 40 is shown in FIG. 7B, and a cross-sectional side view of the non-vented wire connection anode section 40 taken along line 8-8 of FIG. 7A is shown in FIG. 8. The non-vented wire connection anode section 40 does not include the vent tube 22 but is otherwise similar to the vented wire connection anode section 30 and includes a neck 40*a*.

Figure 9:
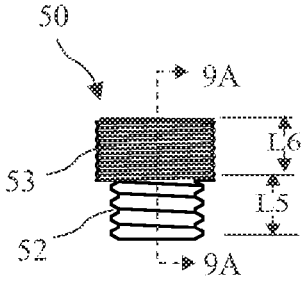
FIG. 9 is a PVC joint according to the present invention, allowing connection of PVC or PE pipe to the wire connection anode sections.
Figure 9A:
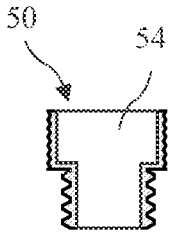
FIG. 9A is a cross-sectional view of the PVC joint according to the present invention, taken along line 9A-9A of FIG. 9.

A side view of a PVC/Teflon® joint 50 according to the present invention, allowing connection of PVC pipe 66 (see FIG. 13) to the wire connection anode sections 30 and 40 is shown in FIG. 9 and a cross-sectional view of the PVC/Teflon® joint 50, taken along line 9A-9A of FIG. 9 is shown in FIG. 9A. The PVC/Teflon® joint 50 includes male threads 52 cooperating with the female threads 14 at a lower end, and an opposite end including male threads 53, which threads 53 are preferably two inch NPT threads. The opposite end further includes a recess 54 for receiving the PVC pipe 66. The PVC/PE pipe 66 may be retained in the PVC/Teflon® joint 50 by gluing or by a standard threaded interface commonly available. The lower end has a length L5 of approximately one inch and the opposite end has a length L6 of approximately one inch. The PVC/PE joint 50 is preferably made from PVC or Teflon®.

Figure 10:
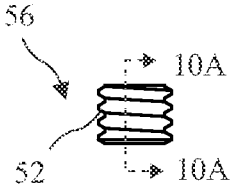
FIG. 10 is a titanium joint for connecting consecutive anode segments.
Figure 10A:
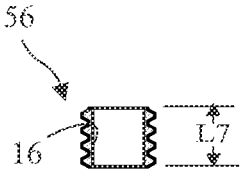
FIG. 10A is a cross-sectional view of the titanium joint according to the present invention, taken along line 10A-10A of FIG. 10.

A side view of a titanium joint 56 for connecting consecutive anode segments is shown in FIG. 10 and a cross-sectional view of the titanium joint 56, taken along line 10A-10A of FIG. 10 is shown in FIG. 10A. The titanium joint 56 exterior defines male threads 52 for electrically and mechanically connecting consecutive anode segments 10 and 20, and the wire connection anode sections 30 and 40 and has a hollow interior to allow gasses collected by the vented Ti MMO anode segment 10 to pass through the titanium joint 56 to be released. The titanium joint 56 preferably includes the internal MMO coating 16 of approximately 20 g/m$^2$ allowing use in soil and liquid mediums.

Figure 11:
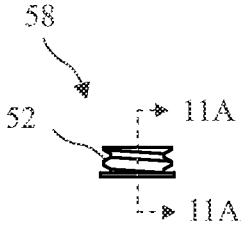
FIG. 11 is a titanium cap according to the present invention, for closing an exposed end of a non-vented anode segment used in a liquid medium.
Figure 11A:
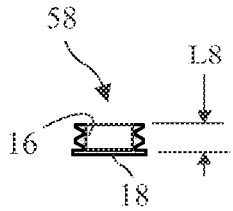
FIG. 11A is a cross-sectional view of the titanium cap according to the present invention, taken along line 11A-11A of FIG. 11.

A titanium cap 58 for closing an exposed end of a non-vented anode segment 20 is shown in FIG. 11 and a cross-sectional view of the titanium cap 58, taken along line 11A-11A of FIG. 11 is shown in FIG. 11A. The titanium cap 58 exterior defines male threads 52 for mechanically connecting to the non-vented anode segment 20, and preferably includes the internal MMO coating 16 and the external MMO coating 18 of approximately 20 g/m$^2$, except the threads 52 which are not coated.

Figure 12:
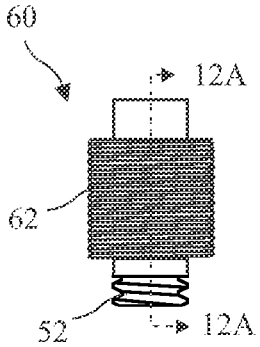
FIG. 12 is a titanium isolation joint according to the present invention, for installing in the wall of a tank or hull and connecting the non-vented wire connection anode section.
Figure 12A:
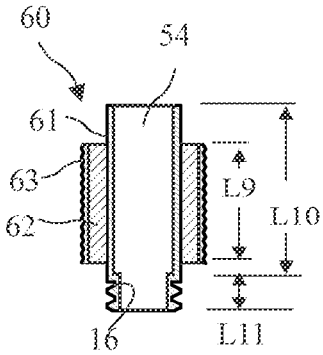
FIG. 12A is a cross-sectional view of the titanium isolation joint according to the present invention, taken along line 12A-12A of FIG. 12.

A titanium isolation joint 60 according to the present invention, for electrically isolating the Ti MMO anode assembly from a tank, hull, vessel, or any structure requiring protection, is shown in FIG. 12 and a cross-sectional view of the titanium isolation joint 60 taken along line 12A-12A of FIG. 12 is shown in FIG. 12A. The titanium isolation joint 60 includes one threaded end to connect to the vented and non-vented wire connection anode sections 30 and 40. The titanium isolator joint 60 includes a steel outer sleeve 63 with male threads 62 for engaging wall of a tank or hull, or a designed flange, a titanium inner sleeve 61, and insulation 62 between the titanium inner sleeve 61 and the steel outer sleeve 63. The insulation 62 is preferably GRE or Nomex® material to electrically isolate the inner sleeve 61. The lower end of the inner sleeve defines the threads 52 for connecting mechanically and electrically with the vented and non-vented wire connection anode segments 30 and 40, and the inner sleeve 61 preferably includes the internal MMO coating 16.

Figure 13:
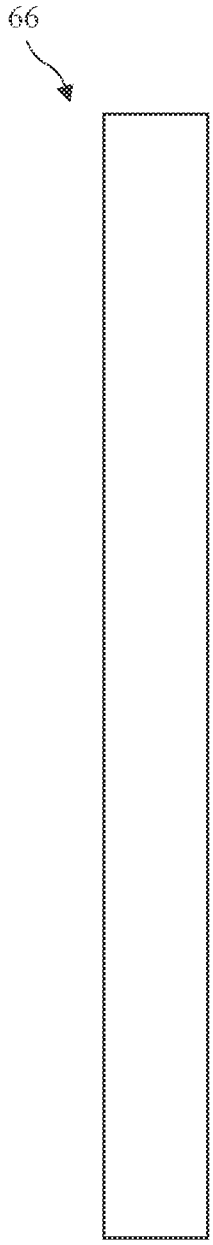
FIG. 13 is a length of PVC or PE pipe for attachment to the PVC joint.

A length of PVC/PE pipe 66 for attachment to the PVC/Teflon® joint 50 is shown in FIG. 13. The PVC/PE pipe 66 forms a non-active portion of the Ti MMO anode assembly reaching though a solid or liquid medium. The lead 26 passes through the PVC/PE pipe 66.

Figure 14:
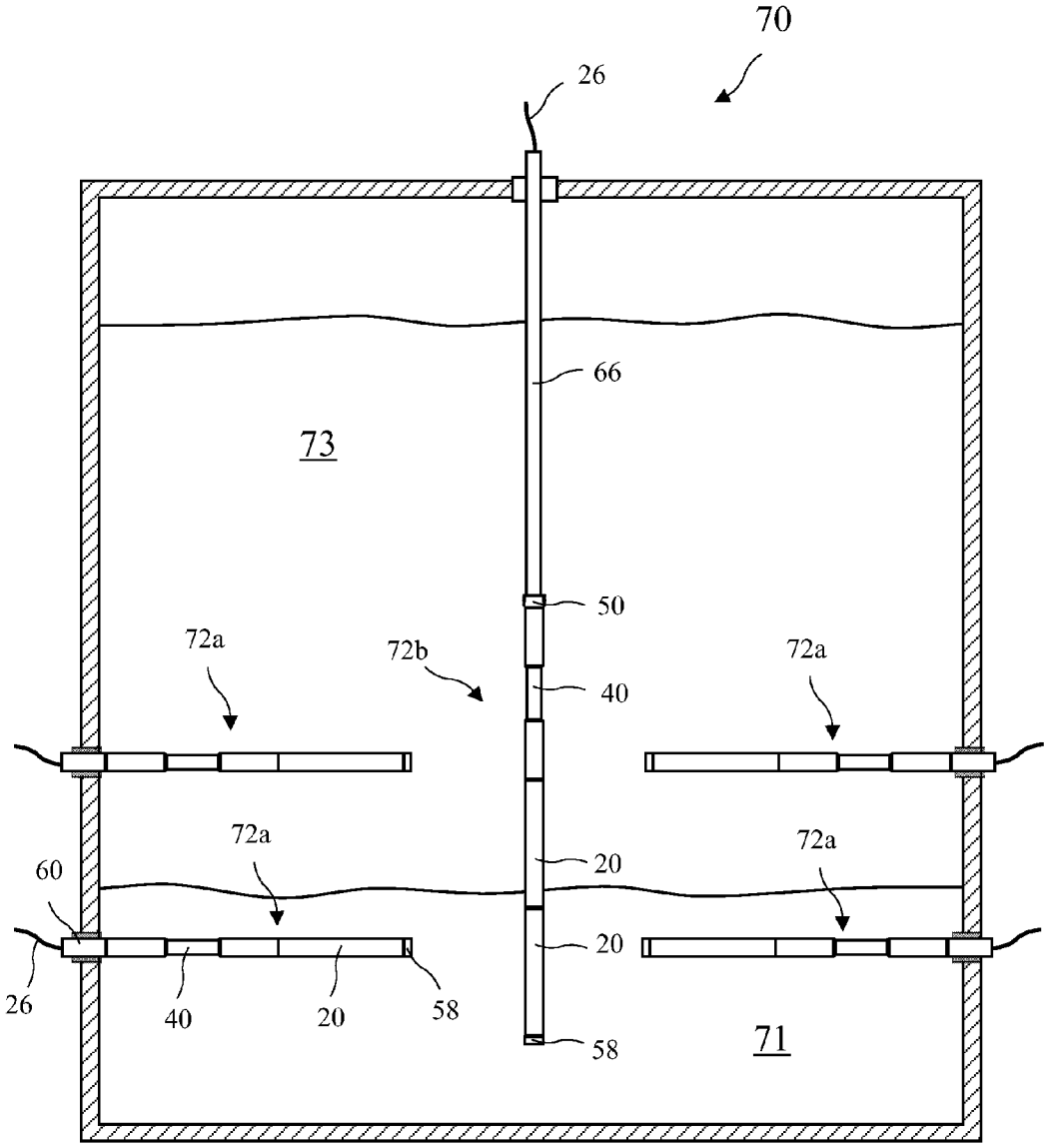
FIG. 14 shows a tank protected by non-vented MMO anode assemblies.

A tank 70 protected by non-vented Ti MMO anode assemblies 72*a* and 72*b* is shown in FIG. 14. The non-vented MMO anode assemblies 72*a* and 72*b* comprise at least one non-vented Titanium MMO anode segment 20 if required, the wire connection anode section 40, the titanium joint 60, and the PVC/PE pipe 66. Tanks 70 often contain a layer of water 71 at the bottom of the tank and a layer of oil or other liquid 73 above the water 71. The length of PVC/PE pipe 66 generally resides in the oil layer. The lengths of the non-vented MMO anode assemblies 72*a* and 72*b* are determined by the number of non-vented MMO anode segments 20 included in each assembly. The lengths of the non-vented MMO anode assemblies 72*a* and 72*b* may be selected based on space available and protection requirements. The length of PVC/PE pipe 66 may be selected to position at least a portion of the non-vented MMO anode assembly 72*b* at a desired depth in the tank 70, preferably in the lower portion of the tank 70 containing the water 71.

Figure 15:
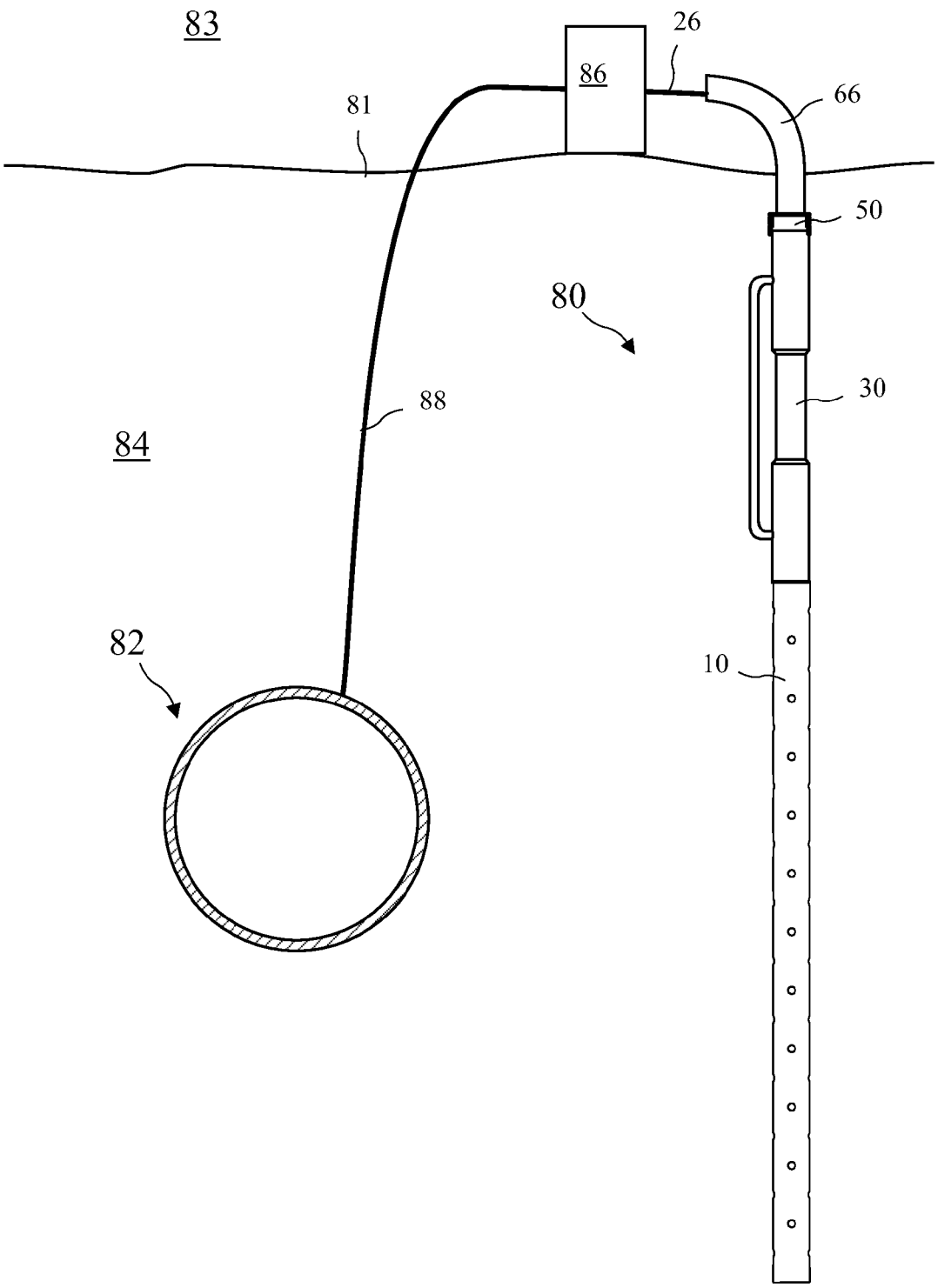
FIG. 15 shows a buried pipeline protected by vented MMO anode assembly.

A buried pipeline 82 protected by a vented MMO anode assembly 80 is shown in FIG. 15. The vented MMO anode assembly 80 is buried proximal to the buried pipeline 82 and a number of vented MMO anode assembly 80 may be buried along a single pipeline 82. A length of PVC, PE, or the like pipe 66 may be used in a non-active zone of the ground bed and the lead 26 passes through the pipe 66 and connects the vented MMO anode assembly 80 to a rectifier assembly 86, and a second lead 88 connects the rectifier 86 to the buried pipe. The gasses created by operation of the Ti MMO anode assembly pass through the pipe 66 buried in the ground 84 to an atmospheric region 83.

Figure 16:
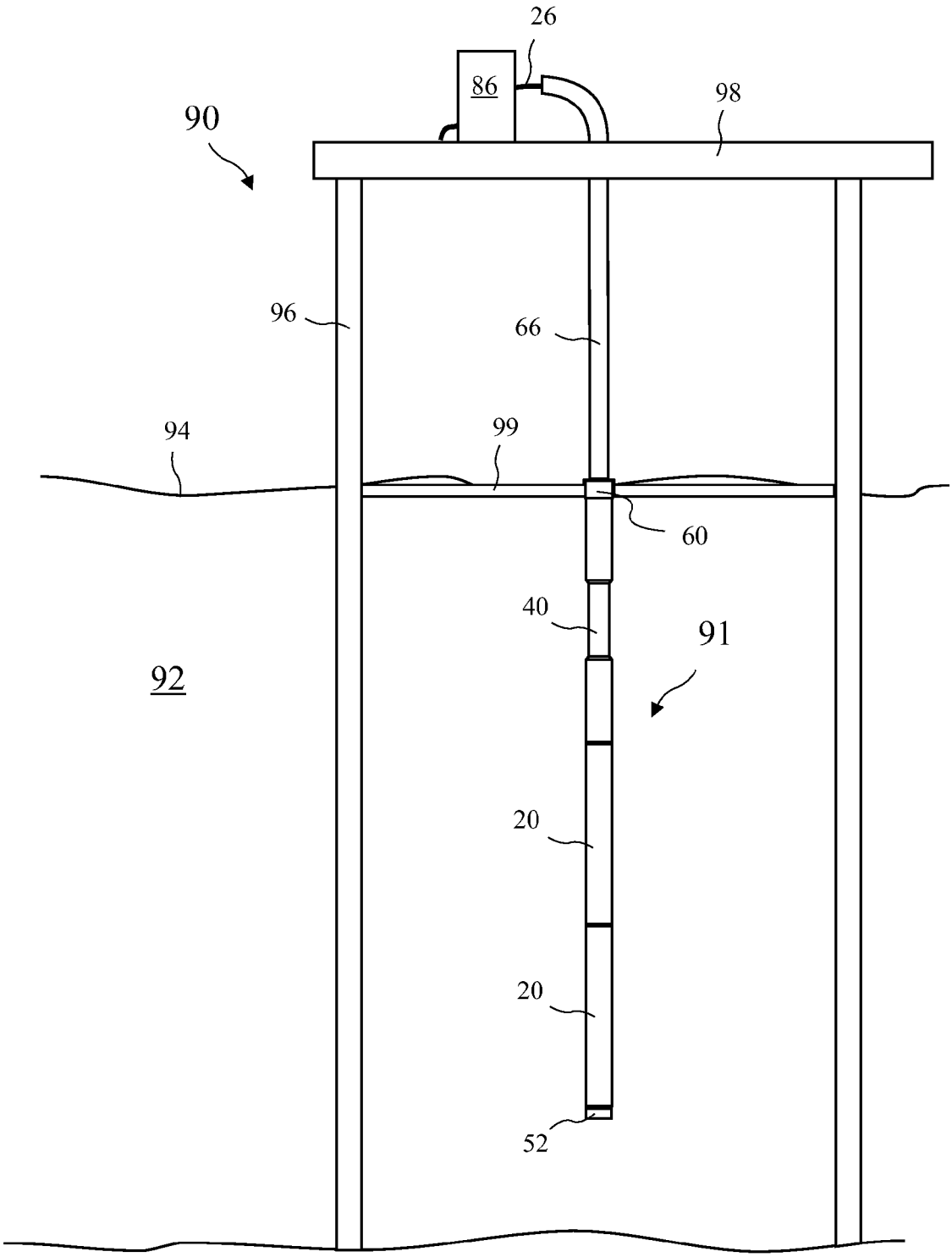
FIG. 16 shows a pier protected by a non-vented MMO anode assembly.

A pier 90 protected by a non-vented MMO anode assembly 91 is shown in a liquid medium 92 in FIG. 16. The pier 90 includes vertical members 96, a top horizontal member 98, and a horizontal support member 99 near the water line 94. A non-vented MMO anode assembly 91 is preferably connected to the horizontal support member 99 by the titanium isolator joint 60. The lead 26 connects the non-vented MMO anode assembly 91 to the rectifier 86, and a second lead 88 connects the rectifier 86 to the pier 90.

For better isolation and pressure resistance, the internal section of the wire connection anode sections 30 and 40 may be sealed by epoxy resins. The epoxy resins plug the center of the wire connection anode sections 30 and 40. The internal surfaces of the wire connection anode sections 30 and 40 may be coated with MMO coatings except where titanium threads of the wire connection anode sections 30 and 40 contact the titanium threads of the joint 56 and isolation joint 60 (see FIG. 10). Ends of the non-vented Titanium MMO anode segment 20 immersed in an electrolyte may be capped using the titanium cap 58 (see FIG. 11).

The Ti MMO anode assembly described above simplifies the design process for engineers by simplifying the resistance calculations, and anode length requirements. The installation of anodes is simplified by removing the need for parallel PVC vent pipes, reduced amount of wires needed for connection to each individual anode from the ground bed to the power supply, removes the need for anode wire holders removing the situation of multiple wires needing control during anode ground bed installation via descent into the well. The Ti MMO anode assembly thus may be easily used in different environments and arrangements such as offshore, tanks, vessels and different soil arrangements such as horizontal, shallow and deep well ground beds by use of four different couplers and joints.

While the invention herein disclosed has been described by means of specific embodiments and applications thereof, numerous modifications and variations could be made thereto by those skilled in the art without departing from the scope of the invention set forth in the claims.

I claim:

1. A vented multi purpose segmented Mixed Metal Oxide (MMO) coated impressed current cathodic protection anode assembly comprising:

at least one anode segment having an exterior and an interior, each anode segment comprising:

a titanium tube;

ports through walls of the titanium tube; and external and internal MMO coating on the titanium tube;

a wire connection anode section made from titanium and connected to an end of one of the at least one anode segment;

the external and internal MMO coating on the wire connection anode section;

a center necked-down portion of the wire connection anode section;

a wire connector press fit into the center necked-down portion;

a lead wire electrically connected to the wire connector;

an isolation material filling the center necked-down portion of the wire connection anode section;

the wire connection anode section includes hollow ends on each side of the center-necked down portion and the isolation material in the center necked-down section blocking fluid communication between ends of the wire connection anode segment a vent tube connecting the hollow ends of the wire connector anode section on each side of the center necked-down portion placing the hollow ends in fluid communication;

threads in both ends of the at least one hollow vented Ti MMO anode segment and in both ends of the wire connection anode section, the threads left uncoated;

an internally MMO coated threaded titanium joint connecting each of the at least one anode segment and connecting the wire connection anode section to an end one of the at least one anode segment, the threaded titanium joint providing electrical connectivity between each of the at least one anode segment and between the wire connection anode section and the end one of the at least one anode segment;

a non-active pipe connected to the wire connection anode section opposite the at least one anode segment;

the external MMO coating on the at least one anode segment in fluid communication with an atmospheric region sequentially through:

the ports in the wall of the at least one hollow vented Ti MMO anode segment;

the hollow interior of the at least one anode segment;

the at least one anode segment closest to the wire connection anode section;

the wire connection anode section passing by way of the vent tube; and through the non-active pipe to the atmospheric region; and the lead wire extending through the non-active pipe and electrically connected between the wire connector and a rectifier assembly.

2. A multi purpose segmented Mixed Metal Oxide (MMO) coated impressed current cathodic protection anode assembly comprising:

at least one anode segment, each anode segment comprising:

a hollow titanium tube; and a Mixed Metal Oxide (MMO) external coating on the titanium tube;

a wire connection anode section connected to an end of one of the at least one anode segment an external MMO coating on the wire connection anode section;

a center necked-down portion of the wire connection anode section;

a wire connector press fit into the center necked-down portion;

a lead wire electrically connected to the wire connector;

an isolation material filling the center necked-down portion;

threads in both ends of the at least one anode segment and of the wire connection anode section, the threads left uncoated;

a threaded titanium joint connecting each of the at least one anode segment and connecting the wire connection anode section to an end one of the at least one anode segment, the threaded titanium joint providing electrical connectivity between each of the at least one anode segment and between the wire connection anode section and the end one of the at least one anode segment;

an isolation joint attached to the wire connection anode section opposite the at least one anode segment, the isolation joint including a titanium inner sleeve connectable to the wire connection anode section, an outer sleeve attachable to a protected structure, and an electrically insulating material between the inner and out sleeves electrically isolating the anode assembly from the structure protected by the anode assembly;

the lead wire extending through the titanium isolation joint and electrically connected between the wire connector and a rectifier assembly; and a threaded titanium cap closing an end of the anode assembly opposite the wire connection anode section, the threaded titanium cap externally coated and the threads uncoated.

3. The anode assembly of claim 1, wherein the MMO coating is 10 g/m2 of MMO comprising iridium, tantalum and titanium oxides for soil mediums.

4. The anode assembly of claim 2, wherein the MMO coating is 20 g/m2 of MMO comprising iridium, tantalum and titanium oxides for liquid mediums.

* * * * *